US006175705B1

(12) United States Patent
Harada et al.

(10) Patent No.: US 6,175,705 B1
(45) Date of Patent: Jan. 16, 2001

(54) IMAGE FORMING APPARATUS

(75) Inventors: Yoshikazu Harada, Nara; Toshio Yamanaka, Yao; Ayumu Oda, Nara; Norio Tomita, Yamatokoriyama; Kyosuke Taka, Nara; Nobuo Manabe, Yamatokoriyama; Takayuki Ohno, Yamatokoriyama; Hideaki Kadowaki, Yamatokoriyama, all of (JP)

(73) Assignee: Sharp Kabushiki Kaisha, Osaka (JP)

( * ) Notice: Under 35 U.S.C. 154(b), the term of this patent shall be extended for 0 days.

(21) Appl. No.: 09/441,546

(22) Filed: Nov. 16, 1999

(30) Foreign Application Priority Data

Nov. 27, 1998 (JP) ..... 10-337137

(51) Int. Cl.[7] ..... G03G 15/00
(52) U.S. Cl. ..... 399/117; 399/167
(58) Field of Search ..... 399/116, 117, 399/167, 13

(56) References Cited

U.S. PATENT DOCUMENTS 4,591,258 5/1986 Nishino et al. .
4,714,337 12/1987 Nishino et al. .
5,347,343 * 9/1994 Ohtsuka et al. ..... 399/117

FOREIGN PATENT DOCUMENTS 52-149125 12/1977 (JP) .
55-052080 4/1980 (JP) .
58-152262 9/1983 (JP) .

* cited by examiner

*Primary Examiner*—William J. Royer
(74) *Attorney, Agent, or Firm*—Renner, Otto, Boisselle & Sklar LLP

(57) ABSTRACT

An object of the invention is to provide an image forming apparatus in which a unit can be attached to the apparatus body in a status where a correct positional correlation between a photoconductive drum and each of other process devices mounted on a unit is maintained. A photoconductive drum is positioned within a copier body by a rotating drive shaft, and the other process devices mounted on a process unit are positioned within a copier body by a boss and a locking member. The boss positions the rotating drive shaft within the copier body. Since the locking member is fitted onto a front-side end of the rotation drive shaft, the locking member is positioned within the copier body by the rotating drive shaft. The other process devices mounted on the process unit are positioned within the copier body by the rotating drive shaft via the boss and the locking member. Accordingly, the photoconductive drum and each of the other process devices, which should maintain a predetermined positional correlation with each other within the copier body, are both positioned within the copier body by the rotating drive shaft.

8 Claims, 6 Drawing Sheets

IMAGE FORMING APPARATUS

BACKGROUND OF THE INVENTION

1. Field of the Invention

The present invention relates to an image forming apparatus provided with a process unit which integrally supports a photoconductive drum and process devices disposed opposite to a surface of the photoconductive drum, which process unit is attachable to and detachable from a predetermined position of the apparatus, wherein the photoconductive drum of the process unit attached to the apparatus is rotated by driving force supplied from a driving mechanism thereto.

2. Description of the Related Art

In an image forming apparatus which performs an image forming process by electrophotography of forming an electrostatic latent image on the surface of a photoconductor by the action of photoconduction and transferring a developer image obtained by making the electrostatic latent image manifest, onto a sheet of paper, not only a developer is consumed, but also a process device such as a photoconductor or a charger is exhausted, so that it is required to replace a process device which has been used for a predetermined period of time. As such an image forming apparatus which performs the image forming process by electrophotography, there is an image forming apparatus in which process devices including a photoconductor which are used in the image forming process are combined into one unit and detachably integrated with the apparatus body, whereby a replacement operation of a process device is facilitated.

Among the process devices included in the unit attachable to and detachable from the apparatus body as described above, the photoconductor is to rotate at a fixed speed during the image forming process, so that it is required to prepare a component for transmitting driving force from a driving mechanism in the apparatus body to the photoconductor in the unit attached to the apparatus body.

For this reason, a conventional image forming apparatus is designed so that a coupling member which is placed on a photoconductor is engaged with a coupling member which is placed on a frame of the apparatus body when the unit is attached to the apparatus body, and so that a driving force from a driving mechanism of the apparatus body is transmitted to the photoconductor through the engagement of both the coupling members.

For example, Japanese Unexamined Patent Publication JP-A 58-152262 (1983) discloses such a configuration that the unit is provided with a driving coupler (a coupling member on the unit side) to which a driving transmission mechanism on the apparatus side (a coupling member on the apparatus side) is coupled, to attach the unit to the apparatus body at a predetermined position by using convex parts which are formed around the driving coupler. These convex parts are a connector for a charger, a connector for a developing device, and a detent pin, which are respectively engaged with a connector of an electric power source for a charger, a connector of an electric power source for a developing device, and a slot, of the apparatus body.

Further, Japanese Unexamined Patent Publication JP-A 52-149125 (1977) and Japanese Unexamined Patent Publication JP-A 55-52080 (1980) disclose a configuration of fitting a photoconductive drum to a drum shaft (a rotating drive shaft), and thereafter securing the photoconductive drum tightly to the drum shaft by a nut.

However, in such a configuration of attaching the unit to the apparatus body as adopted in the conventional image forming apparatus disclosed by JP-A 58-152262 and so on, the photoconductive drum and other process devices such as the charger or the developing device of the unit are respectively positioned in the apparatus body via individual coupling members, so that there is a problem such as the image quality is degraded due to a difference and skewness in an image forming position on the surface of the photoconductive drum.

This is because a fitting position of the photoconductive drum to the apparatus body is determined without reference to fitting positions of the other process devices one another to the apparatus body, and the fitting position of the photoconductive drum and the fitting positions of the other process devices make differences individually relative to the apparatus body, with the result that a difference is made in a positional correlation between the photoconductive drum and each of the other process devices.

In an image forming apparatus which adopts a digital exposure system of performing exposure by image light for each one line in the direction of main scanning, positions where the other process devices perform processes to the surface of the photoconductive drum affect on an image forming status significantly, and the image quality is easily degraded due to positional differences between the photoconductive drum and the other process devices, so that the problem mentioned above is especially critical in the image forming apparatus adopting the digital exposure system.

SUMMARY OF THE INVENTION

An object of the invention is to provide an image forming apparatus which allows a photoconductive drum to be attached at a correct position to the apparatus body and allows a unit mounted with the photoconductive drum and other process devices to be attached to the apparatus body in a status where correct positional correlations between the photoconductive drum and the other process devices of the unit are maintained.

The invention provides an image forming apparatus provided with a unit mounted with a photoconductive drum and other process devices which is attachable to and detachable from a body of the apparatus, comprising:

a coupling member which is fitted onto a rotating drive shaft onto which the photoconductive drum is fitted, and onto which coupling member a part of a main body of the unit, mounted with the other process devices, is fitted.

According to the invention, the photoconductive drum is positioned directly by the rotating drive shaft and the main body of the unit is positioned by the rotating drive shaft via the coupling member, whereby it is possible to position the photoconductive drum and the other process devices mounted on the main body of the unit by the rotating drive shaft, prevent a difference in positional correlation between them from expanding as a result of positioning them by individual members in the apparatus body, and suppress degradation of the image quality due to the positional difference between the photoconductive drum and the other process devices.

In the invention it is preferable that the photoconductive drum is supported only by the rotating drive shaft.

According to the invention, the photoconductive drum is designed not to be supported by the main body of the unit, whereby it is possible to prevent vibrations which occur in the other process devices mounted on the main body of the unit, from being transmitted to the photoconductive drum via the main body of the unit, and it is possible to reliably prevent the image quality from being degraded due to the vibrations occurring in the other process devices.

In the invention it is preferable that the coupling member is provided with a hole in which the rotating drive shaft is fitted, and an outer periphery which is concentric with the hole, and the coupling member is shaped like a cylinder so that a part of the main body of the unit is fitted onto the outer periphery of the coupling member.

According to the invention, the coupling member is provided with a hole and an outer periphery which are concentric with each other, to fit the rotating drive shaft in the hole and fit a part of the main body of the unit onto the outer periphery, whereby it is possible to place the rotating drive shaft which determines a position of the photoconductive drum in the apparatus body, and the part of the main body of the unit so as to be concentric with each other, and correctly maintain positional correlations between the photoconductive drum and the other process devices mounted on the main body of the unit in the apparatus body, using the rotation drive shaft.

In the invention it is preferable that the coupling member is a shaft supporting member which supports a back-side portion of the rotating drive shaft in the apparatus body.

According to the invention, the part of the main body of the unit is fitted onto the shaft supporting member for supporting the back-side portion of the rotating drive shaft, whereby it is possible to correctly maintain positional correlations between the photoconductive drum and the other process devices on the back side of the apparatus body by using the rotating drive shaft.

In the invention it is preferable that the coupling member is a movement regulating member which is attached to a front-side end of the rotating drive shaft, to regulate movement of the photoconductive drum in an axial direction of the rotating drive shaft.

According to the invention, the part of the main body of the unit is fitted onto the movement regulating member placed at the front-side portion of the rotating drive shaft, whereby it is possible to correctly maintain positional correlations between the photoconductive drum and the other process devices on the front side of the apparatus body by using the rotating drive shaft.

In the invention it is preferable that the unit is fixed to a body-side frame of the apparatus body and is provided with a unit-side frame which supports the movement regulating member, and the main body of the unit is supported only by the movement regulating member.

According to the invention, the main body of the unit is supported only by the movement regulating member supported by the unit-side frame fixed to the body-side frame, whereby it is possible to keep the main body of the unit from directly coming in contact with the unit-side frame fixed to the body-side frame, prevent vibrations of the apparatus body from being transmitted to the other process devices mounted on the main body of the unit via the body-side frame and the unit-side frame, and thereby reliably prevent a breakdown of the process device from occurring due to the vibrations of the apparatus body.

In the invention it is preferable that the coupling member, together with a front-side end of the photoconductive drum, is fitted onto a small diameter portion which is formed in a vicinity of the front-side end of the rotating drive shaft so that the front-side end of the photoconductive drum is interposed between a back-side end face of the coupling member and a stair portion on a back side of the small diameter portion of the rotating drive shaft, to transmit rotation of the rotating drive shaft to the photoconductive drum.

According to the invention, the front-side end of the photoconductive drum and the coupling member are fitted onto the small diameter portion formed in the vicinity of the front-side end of the rotating drive shaft, to interpose the front-side end of the photoconductive drum between the back-side end face of the coupling member fit on the front-side end of the rotating drive shaft and the stair portion on the back side of the small diameter portion of the rotating drive shaft, whereby it is possible to reliably regulate the movement of the photoconductive drum in an axial direction of the rotating drive shaft by using a single coupling member which is placed at the front-side end of the rotating drive shaft, and it is possible to transmit rotation of the rotating drive shaft to the photoconductive drum via the back-side end face of the coupling member and the stair portion on the back side of the small diameter portion of the rotating drive shaft. As a result, it is possible to simplify the structure and facilitate the assembly operation.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
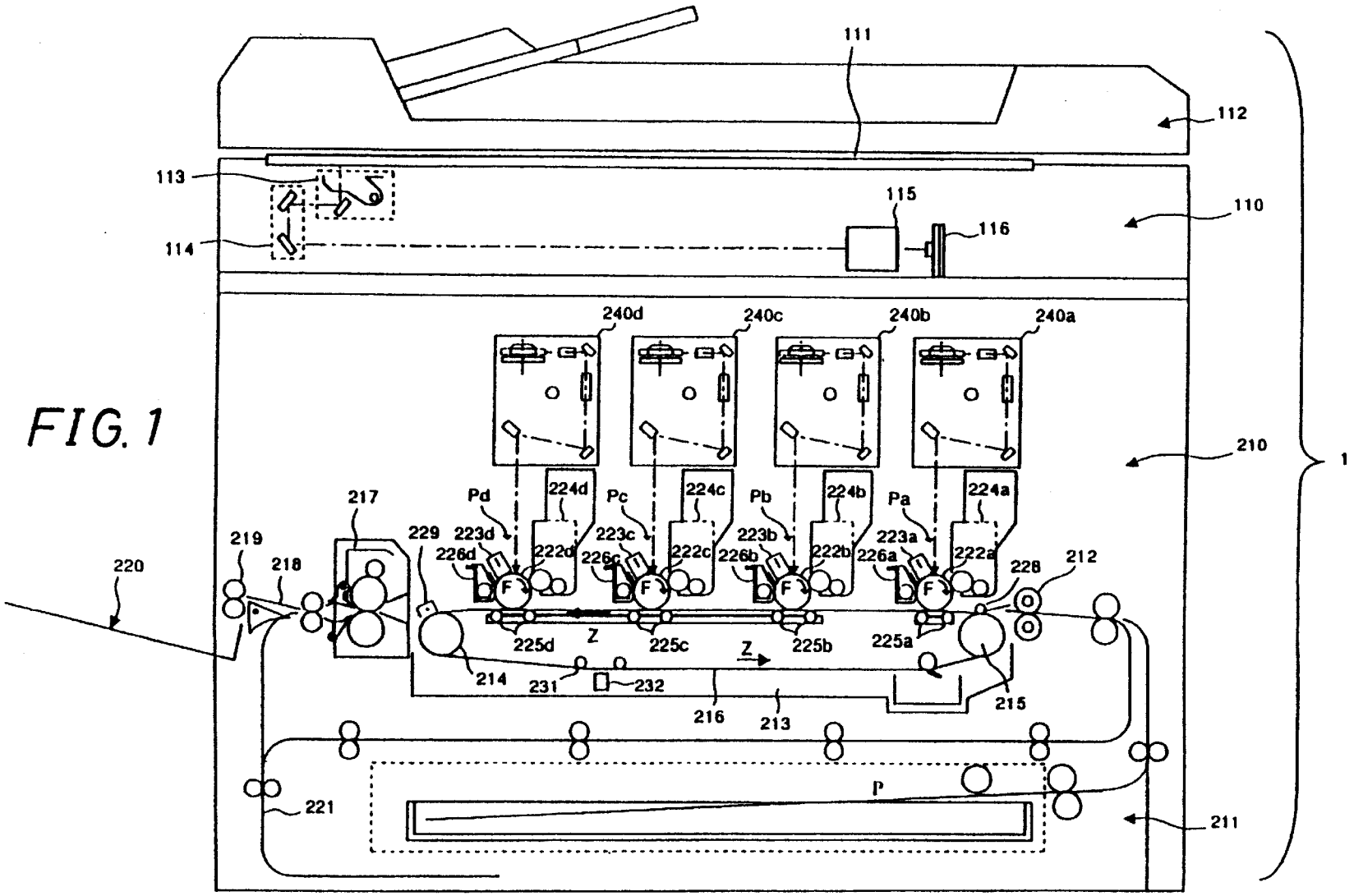
FIG. 1 is a schematic sectional front view showing a configuration of a digital full-color copier which is an image forming apparatus according to an embodiment of the invention.

Now referring to the drawings, preferred embodiments of the invention are described below.

FIG. 1 is a schematic sectional front view showing a configuration of a digital full-color copier which is an image forming-apparatus according to an embodiment of the invention. An original-document glass plate 111 and an operation panel (not shown) are placed on the top face of a copier body 1 of the digital full-color copier, and an automatic original-document feeder 112 is mounted on the top face of the original-document glass 111 so as to be capable of opening and closing. Further, an image reading section 110 and an image forming section 210 are formed inside the copier body 1.

With regard to double-faced original-documents with images formed on both faces thereof, the automatic original-document feeder 112 feeds the original-documents set in an original-document tray, one by one to a predetermined position on the top face of the original-document glass 111 in a status where one face of the fed original-document is opposed to the top face of the original-document glass 111, performs an image reading process to the one face, and thereafter reverses the original-document to feed it to a predetermined position on the top face of the original-document glass 111 in a status where the other face of the fed original-document is opposed to the top face of the original-document glass 111. After finishing the image reading process to both the sides of one original-document, the automatic original-document feeder 112 ejects the original-document, and sequentially feeds all of the original-documents set in the original-document tray, in a status where each face of the original-documents are opposed to the top face of the original-document glass 111. An original-document feeding process including a reversing process performed in the automatic original-document feeder 112 is controlled in association with an operation of the entire copier body 1.

The image reading section 110 reads an image of an original-document which is fed to the top face of the original-document glass 111 by the automatic original-document feeder 112. Therefore, the image reading section 110 is provided with a first mirror base 113 and a second mirror base 114 which move to and fro along the bottom face of the original-document glass 111. On the first mirror base 113 are mounted an exposure lamp and a mirror, which first mirror base moves to and fro at a preset speed along the bottom face of the original-document feeder 111. On the second mirror base 114 are mounted two mirrors, which second mirror base moves to and fro at a speed half of that of the first mirror base 113 along the bottom face of the original-document feeder 111.

Light which is emitted from the exposure lamp included in the first mirror base 113 is reflected on an image face of an original-document, further reflected on the mirrors included in the first mirror base 113 and the second mirror base 114, and formed into an image on a light-receptive face of a photoelectric conversion element 116 by a lens 115. The photoelectric conversion element 116 outputs a light-receiving signal corresponding to the light amount of reflection light on the light-receptive face. The light-receiving signal outputted from the photoelectric conversion element 116 is subjected to a predetermined process in an image processing section which is not shown in the drawings, and used as image data.

Inside the copier body 1, a paper feeding section 211 is placed below the image forming section 210. The paper feeding section 211 feeds plural sheets of paper held in a paper feeding cassette, separating one by one. The sheets of paper fed from the paper feeding section 211 are guided into the image forming section 210 at synchronous timing with an operation of the image forming section 210. In the lower part of the image forming section 210, a conveying belt 216 which rotates in the direction of an arrow Z is placed in a status of being stretched between a pair of rollers 214, 215, and the sheets of paper guided into the image forming section 210 are conveyed within the image forming section 210 in a status of being electrostatically attracted to the surface of the conveying belt 216.

Inside the copier body 1, a fixing unit 217 is placed on the downstream side in the direction of the arrow Z on the top face of the conveying belt 216. The fixing unit 217 heats and pressurizes a sheet of paper with a developer image transferred on the surface thereof in the image forming section 210, to fuse and fix the developer image onto the surface of the sheet of paper. After being passed through the fixing unit 217, the sheet of paper is ejected by a paper ejecting roller 219 to a paper ejecting tray 220 which is attached to one side of the copier body 1. Further, a gate 218 which is placed between the fixing unit 217 and the paper ejecting roller 219 selectively guides a single-face-copied sheet of paper passed through the fixing unit 217 into a switchback conveying path 221 in a double-faced copy mode. The single-face-copied sheet of paper guided into the switchback conveying path 221 is again guided into the image forming section 210 in a status of being reversed.

In the image forming section 210, above the conveying belt 216, four image forming stations Pa through Pd are placed so as to be opposed to the top face of the conveying belt 216 from the upstream side in the direction of the arrow Z in this order. Therefore, to the top face of a sheet of paper conveyed by the conveying belt 216 within the image forming section 210, the image forming stations Pa through Pd are opposed in this order.

The configurations of the respective image forming stations Pa through Pd are substantially the same. For example, the image forming station Pa is equipped with: a photoconductive drum 222*a* which is driven to rotate at a constant speed in the direction of an arrow F; a charger 223*a* which uniformly supplies electrical charge of single polarity to the surface of the photoconductive drum 222*a;* a developing device 224*a* which changes an electrostatic latent image formed on the surface of the photoconductive drum 222*a,* into a developer image; a transfer device 225*a* which transfers the developer image held on the surface of the photoconductive drum 222*a,* to the surface of a sheet of paper; and a cleaner 226*a* which removes toner residues from the surface of the photoconductive drum 222*a* passed by a position which is opposed to the transfer device 225*a* via the conveying belt 216.

Above the image forming stations Pa through Pd, laser units 240*a* through 240*d* are placed, respectively. The configurations of the laser units 240*a* through 240*d* are substantially the same. For example, the laser unit 240*a* includes: a semiconductor laser device (not shown) which emits laser light modulated based on image data; a polygon mirror which polarizes the laser light emitted from the semiconductor laser device in the direction of main scanning; and an f θ lens and a mirror which form an image on the surface of the photoconductor with the laser light polarized by the polygon mirror. According to this configuration, the respective laser units 240*a* through 240*d* emit image lights based on image data of the respective colors which are obtained by color separation of an original-document color image, to the surfaces of the photoconductive drums 222*a* through 222*d.*

A photoconductive layer is formed on the surface of each of the photoconductive drums 222*a* through 222*d.* From parts of the surfaces of the photoconductive drums 222*a* through 222*d,* the parts having been subjected to emission of the laser lights from the laser units, electrical charge which is supplied from the chargers 223*a* through 223*d* before the emission of the laser lights is selectively removed by the action of photoconduction, whereby electrostatic latent images based on the image data of the respective colors are formed on the surfaces of the respective photoconductive drums 222*a* through 222*d.* In addition, each of the developing devices 224*a* through 224*d* supplies the same color of toner as the color of the image data to which the laser light emitted from the laser unit corresponds, to the surface of each of the photoconductive drums 222*a* through 222*d.*

Timing of emitting the laser light from the laser units 227*a* through 227*d* in the respective image forming stations Pa through Pd is determined on the basis of a moving speed of the top face of the conveying belt 216 in the direction of the arrow Z and on the basis of an interval of placing the photoconductive drums 222*a* through 222*d,* and the respective colors of toner images held on the respective photoconductive drums 222*a* through 222*d* are overlaid at a single position on the surface of a sheet of paper.

Further, a charger 228 is in contact with the top face of the conveying belt 216 on the upstream side of the image forming station Pa in the direction of the arrow Z, and an eliminator 229 is in contact with the top face of the conveying belt 216 on the downstream side of the image forming station Pd in the direction of the arrow Z. The charger 228 supplies an electrical charge for electrostatically attracting a sheet of paper to the surface of the conveying belt 216, to the surfaces of the conveying belt 216 and the sheet of paper. The eliminator 229 performs the corona discharge for peeling the sheet of paper off the surface of the conveying belt 216.

In the configuration described above, the photoconductive drums 222*a* through 222*d,* the chargers 223*a* through 223*d,* the developing devices 224*a* through 224*d,* and the cleaners 226*a* through 226*d,* which compose the image forming stations Pa through Pd, are installed as individual process units in the respective image forming stations Pa through Pd so as to be attachable to and detachable from the copier body 1.

Figure 2:
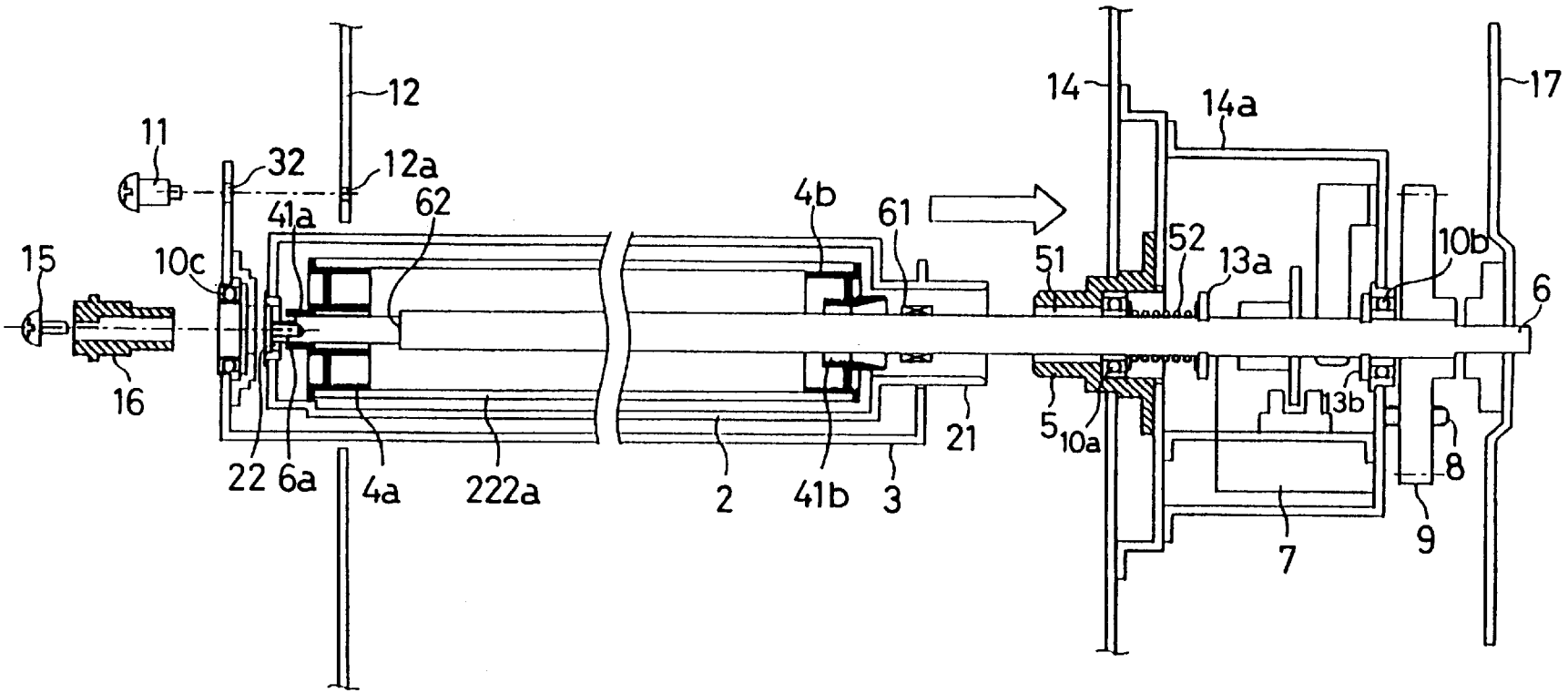
FIG. 2 is a sectional side view showing a configuration of a process unit and a coupling member in each image forming station of the digital full-color copier, and showing a fitting status of the process unit.
Figure 3:
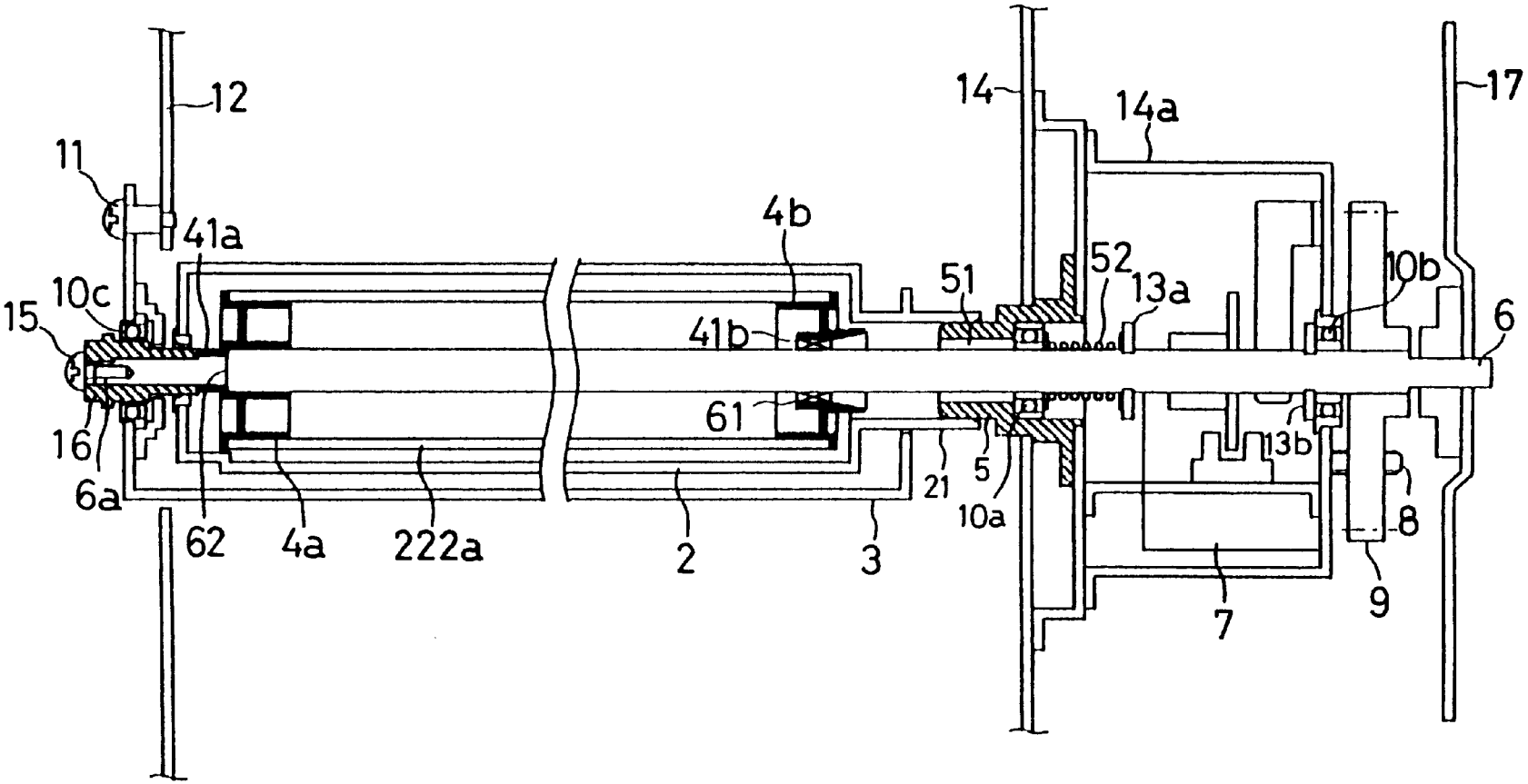
FIG. 3 is a sectional side view showing the same as shown by FIG. 2.

FIGS. 2 and 3 are sectional side views showing a configuration of a process unit and a coupling member in each image forming station of the digital full-color copier, and showing a fitting status of the process unit. Although FIGS. 2 and 3 show the configuration and the fitting status in the image forming station Pa as an example, the configurations of the image forming stations Pa through Pd are the same within the copier body 1 as mentioned above, and hence the configurations and fitting statuses in the image forming stations Pb through Pd are the same as those of the image forming station Pa.

The photoconductive drum 222*a* is one of the constituents of the image forming station Pa in the copier body 1, and is mounted on a process unit 2, together with other process devices such as the charger 223*a,* the developing device 224*a* and the cleaner 226*a.* Description of the process devices other than the photoconductive drum 222*a,* that is, description of the process devices such as the charging unit 223*a,* the developing device 224*a,* or the cleaner 226*a,* is omitted in the drawings. The process unit 2 is supported by a unit-side frame 3, and at the time of replacement of the process devices including the photoconductive drum 222*a,* the unit-side frame 3 attached to the copier body 1 is drawn out to the front side, and thereafter the unit-side frame 3 supporting the process unit 2 including a new process device is pushed in from the front side to the back side.

The photoconductive drum 222*a* is shaped like a hollow cylinder, and at front-side and back-side ends thereof are placed flanges 4*a,* 4*b,* respectively, in the center of which through holes 41*a,* 41*b* are formed. A rotating drive shaft 6 which is supported by a back-side frame 14 of the copier body 1 in the vicinity of the back-side end is passed through these through holes 41*a,* 41*b* and the inside of the photoconductive drum 222*a,* whereby the photoconductive drum 222*a* is positioned within the copier body 1.

A boss 5 with a hole 51 through which the rotating drive shaft 6 is passed is fixed to the back-side frame 14 within the copier body 1. This boss 5 is a shaft supporting member of the invention, inside which a bearing 10*a* is held. Further, a driving unit frame 14*a* is fixed on the back face of the back-side frame 14. This driving unit frame 14*a* supports at least a motor 7 and a bearing 10*b.* A portion of the rotating drive shaft 6 in the vicinity of the back-side end is passed through the boss 5 and the driving unit frame 14*a* and is exposed on the back face of the driving unit frame 14*a.* To a portion of the rotating drive shaft 6 which is exposed on the back face of the driving unit frame 14*a,* a driving gear 9 and a flywheel 17 are attached. The driving gear 9 is meshed with a motor gear 8 which is mounted on a rotation shaft of the motor 7 supported by the driving unit frame 14*a.* The flywheel 17 causes an inertial force to act on rotation of the rotating drive shaft 6.

Rings 13*a,* 13*b* are fixed to a portion of the rotating drive shaft 6 which is positioned within the driving unit frame 14*a,* and a spring 52 is fitted onto a portion of the rotating drive shaft 6 between the ring 13*a* and the bearing 10*a.* Due to the elastic force of the spring 52, the rotating drive shaft 6 is pressed toward the back face. The rotating drive shaft 6 is positioned in an axial direction within the copier body 1 in a status where the ring 13*b* and the bearing 10*b* abut against each other due to the elastic force of the spring 52.

The boss 5 is shaped like a cylinder which has two different sizes of inner diameters and five different sizes of outer diameters. The outer diameter on the forefront of the boss 5 is designed to be equal to the inner diameter of a small diameter portion 21 which is formed at the back-side end of the process unit 2. Further, with regard to the boss 5, at least the outer diameter on the forefront and the inner diameter on the back side are formed so as to be concentric with each other. As described later, when the process unit 2 is attached to the copier body 1 via the unit-side frame 3, the small diameter portion 21 of the process unit 2 is fitted onto a portion corresponding to the outer diameter on the forefront of the boss 5.

At the front-side end of the unit-side frame 3, a bearing 10*c* is fixed and a hole 32 is formed. After the unit-side frame 3 is fitted to the copier body 1, a fixing screw 11 is passed through the hole 32 and screwed in a screw hole 12*a* which is formed on a front-side frame 12 of the copier body 1, whereby a position of the unit-side frame 3 within the copier body 1 is fixed. Further, a locking member 16 is fitted in the bearing 10*c* from the front side. The locking member 16 is a movement regulating member of the invention and shaped like a substantial cylinder, in which the front-side end of the rotating drive shaft 6 is fitted, and against the back-side end face thereof the front-side end face of the flange 4*a* abuts. In addition, a fixing screw 15 is screwed in a screw hole 6*a* which is formed at the front-side end of the rotating drive shaft 6.

The invention is not limited to a configuration that the unit-side frame 3 is fixed to the front-side frame 12 by using the fixing screw 11, and not limited to a configuration that the locking member 16 is fixed to the rotating drive shaft 6 by using the fixing screw 15.

In the configuration described above, at the time of fitting the unit-side frame 3 to the copier body 1, the unit-side frame 3 is pushed in from the front side to the back side within the copier body 1 in a status where the rotating drive shaft 6 is passed through the process unit 2 and the photoconductive drum 222*a.* With this operation, the small diameter portion 21 formed at the back-side end of the process unit 2 supported by the unit-side frame 3 is fitted onto the boss 5, with the result that the back-side portion of the process unit 2 is positioned. Further, the rotating drive shaft 6 is passed through the through hole 41*a* of the flange 4*a* fixed to the front-side end of the photoconductive drum 222*a,* whereby the front-side portion of the photoconductive drum 222*a* is positioned.

When the unit-side frame 3 is pushed in up to a predetermined position in the fore-and-aft direction of the copier body 1, and the front-side portion of the unit-side frame 3 is fixed to the front-side frame 12 by the fixing screw 11, a guide member 61 which is shaped like a cylinder and fixed to the midpoint portion of the rotating drive shaft 6 is fitted in the through hole 41*b* of the flange 4*b* fixed to the back-side end of the photoconductive drum 222*a*. With this fit of the guide member 61 in the through hole 41*b*, the back-side portion of the photoconductive drum 222*a* is also positioned. However, in this status, the front-side portion of the process unit 2 has not been positioned yet, and the front-side end of the rotating drive shaft 6 is exposed on the front side of the unit-side frame 3.

After that, in a status of being fitted onto the front-side end of the rotating drive shaft 6 exposed on the front side of the unit-side frame 3, the locking member 16 is fitted in the bearing 10*c* and a hole 22 formed on the front-side portion of the process unit 2. With this fit of the locking member 16 in the hole 22, the front-side portion of the process unit 2 is positioned. After that, the fixing screw 15 is screwed in the screw hole 6*a* formed at the front-side end face of the rotating drive shaft 6, whereby the flange 4*a* fixed to the front-side end of the photoconductive drum 222*a* is interposed between the rotating drive shaft 6 and a stair portion 63 of the rotating drive shaft 6.

In this way, the photoconductive drum 222*a* is positioned within the copier body 1 by the rotating drive shaft 6 supplying rotation to the photoconductive drum 222*a* at the flanges 4*a*, 4*b*, and the other process devices mounted on the process unit 2 are positioned within the copier body 1 by the boss 5 and the locking member 16. The boss 5 is a member which positions the rotating drive shaft 6 within the copier body 1. Further, the locking member 16 is fitted onto the front-side end of the rotating drive shaft 6, so that the locking member 16 is positioned within the copier body 1 by the rotating drive shaft 6. Therefore, the process devices other than the photoconductive drum 222*a*, mounted on the process unit 2 are to be positioned within the copier body 1 by the rotating drive shaft 6 via the boss 5 and the locking member 16.

As described above, in this embodiment, the photoconductive drum 222*a* and each of the other process devices, which should maintain a predetermined positional correlation among them within the copier body 1, are both positioned by the rotating drive shaft 6 within the copier body 1. Therefore, positional differences would not be accumulated between the photoconductive drum 222*a* and the copier body 1, and between each of the other process devices and the copier body 1, and would not cause positional differences between the photoconductive drum 222*a* and the other process devices, as found in a case where the photoconductive drum 222*a* and the other process devices are individually positioned within the copier body 1. As a result, it is possible to minimize the positional differences between the photoconductive drum 222*a* and the other process devices.

Figure 4A:
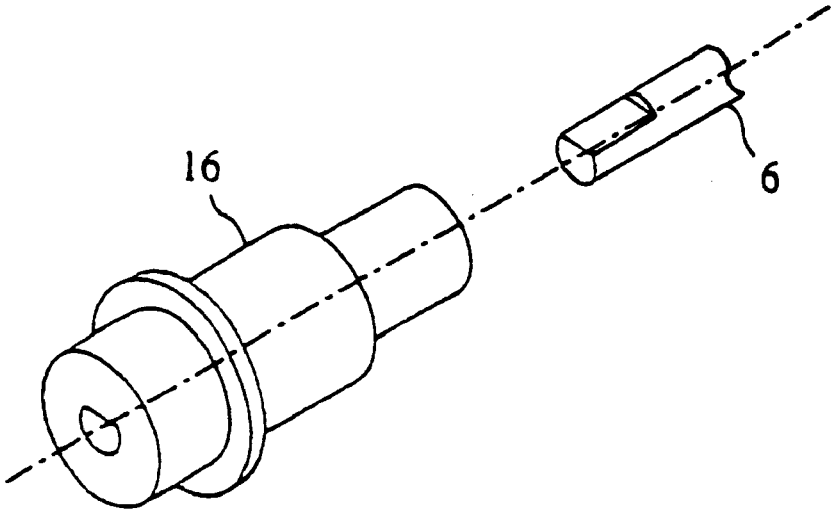
FIGS. 4A and 4B are perspective views showing shapes of a front-side end of a rotating drive shaft and a locking member which serves as a coupling member of the copier.
Figure 4B:
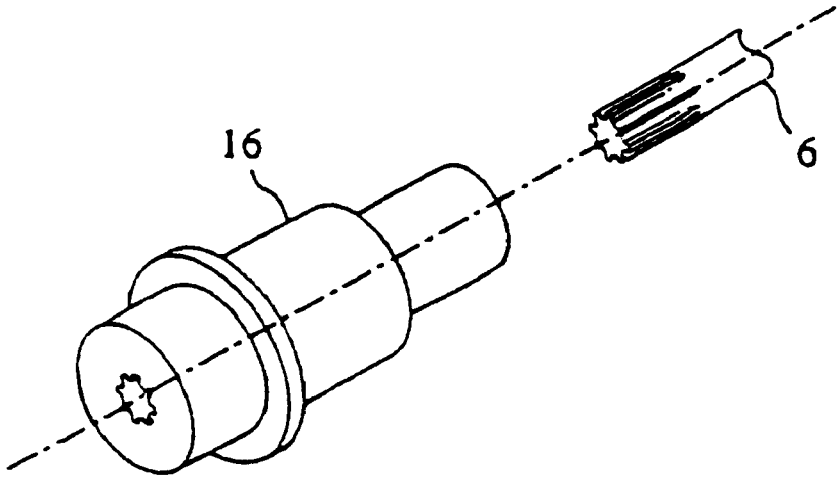

At least a part of an outer periphery in the vicinity of the front-side end of the rotating drive shaft 6 and at least a part of an inner periphery of the locking member 16 are both designed to have the same shape of even-face portion, and the front-side end of the rotating drive shaft 6 and the locking member 16 are designed, for example, to have the same size and shape of D-shaped section as shown in FIG. 4A. With such designs, rotation of the rotating drive shaft 6 is transmitted to the locking member 16 in a reliable manner. Further, it is also possible to produce the same effect by designing the front-side end of the rotating drive shaft 6 and the inner periphery of the locking member 16 to have a spline shape as shown in FIG. 4B.

Figure 5A:
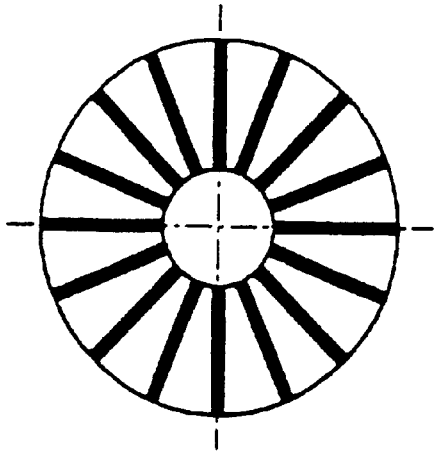
FIGS. 5A through 5C are views showing shapes of a back-side end face of the locking member or a front-side end face of a flange of a photoconductive drum.
Figure 5B:
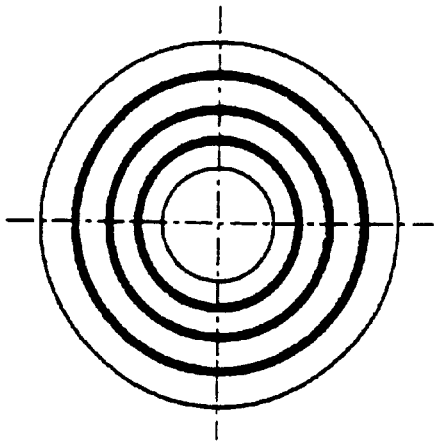
Figure 5C:
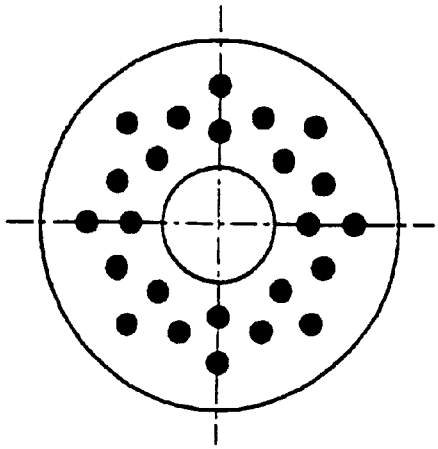

Further, either the front-side end face of the flange 4*a* fixed to the front-side end of the photoconductive drum 222*a*, or the back-side end face of the locking member 16 is designed, for example, to have any shape of uneven surface shown in FIGS. 5A through 5c, and the other is designed to have an even surface. Moreover, the hardness of the uneven surface is made sufficiently high as compared with the hardness of the plane. In this configuration, when the fixing screw 15 is screwed in the front-side end face of the rotating drive shaft 6, the back-side end face of the locking member 16 and the front-side end face of the flange 4*a* abut against each other, and then the uneven surface is engaged into the even surface, whereby both are integrated. In this configuration, rotation which is transmitted from the rotating driving shaft 6 to the locking member 16 is further transmitted from the locking member 16 to the photoconductive drum 222*a*. In this case, it is required to form the uneven surface either on the back-side end face of the locking member 16 or on the front-side end face of the flange 4*a* so as to be uniform in the direction of the perimeter. This aims to prevent integration between the uneven surface and the even surface from being impaired and a rotation failure from occurring at the photoconductive drum 222*a*, during operation.

Furthermore, the surface roughness of at least either the back-side end face of the flange 4*a* or a stair portion 62 of the rotating drive shaft 6 is made rough, whereby it is possible to avoid slide at the back-side end face of the flange 4*a* and the stair portion 62 of the rotating drive shaft 6, and sturdily interpose the flange 4*a* between the locking member 16 and the stair portion 62 of the rotating drive shaft 6. As a result, it is ensured that rotation of the rotating drive shaft 6 is transmitted to the photoconductive drum 222*a* via the locking member 16.

As shown in FIG. 3, in a status where the process unit 2 and the photoconductive drum 222*a* are positioned within the copier body 1 via the unit-side frame 3, the photoconductive drum 222*a* containing the flanges 4*a*, 4*b* is not in contact with the process unit 2, and the photoconductive drum 222*a* is kept in a status of being entirely separated from the process unit 2. In this configuration, vibrations and shocks which occur in the other process devices mounted on the process unit 2 would not be propagated directly to the photoconductive drum 222*a*, so that it is possible to prevent the image quality from being degraded due to vibrations of the photoconductive drum 222*a*.

Such an effect is more enhanced by forming the locking member 16 with a material which has a vibration-protecting or vibration-damping function. That is to say, in a case where the locking member 16 is formed with, as a material, a synthetic resin, an alloy of aluminum and zinc, an alloy of magnesium and zirconium, or the like, it is possible to prevent that the vibrations and shocks occurring in the process unit 2 are propagated from the locking member 16 to the rotating drive shaft 6 and further propagated from the rotating drive shaft 6 to the photoconductive drum 222*a*. Moreover, according to this configuration, it is also possible to prevent that the vibrations and shocks occurring in the process unit 2 are propagated to the other devices within the copier body 1 via the locking member 16, and on the contrary, vibrations and shocks occurring in the other devices within the copier body 1 are propagated to the photoconductive drum 222*a* via the locking member 16.

Figure 6:
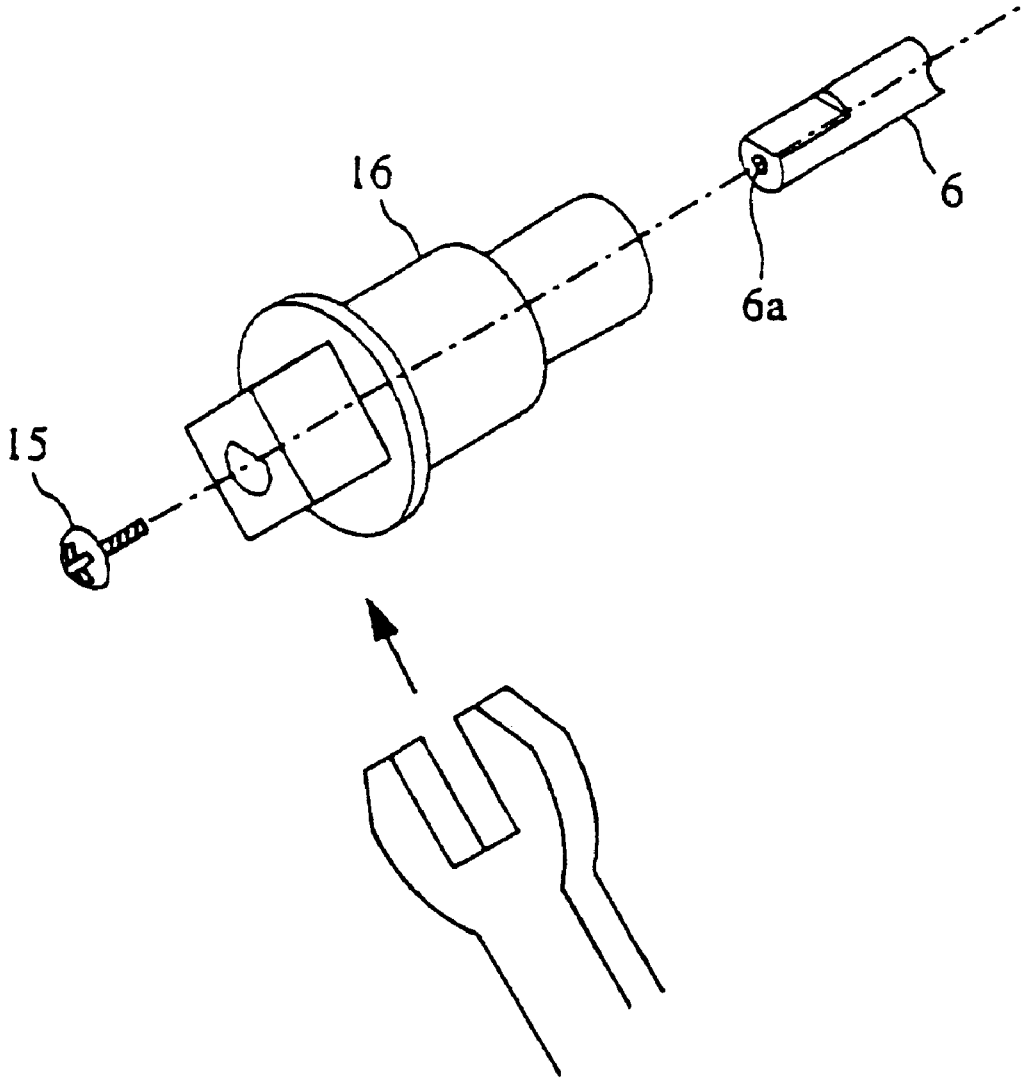
FIG. 6 is a perspective view showing another shape of the locking member.

Further, an even surface is formed at least on a part of the outer periphery of the front-side portion of the locking member 16 and a tool is engaged into this part to avoid rotation of the locking member 16 and the rotating drive shaft 6, whereby the fixing screw 15 can be attached to and detached from the screw hole 6*a* of the rotating drive shaft 6 in a simple and reliable manner. The outer periphery of the front-side portion of the locking member 16 is shaped like, e.g., a square prism as shown in FIG. 6, and a wrench is engaged into the square prism portion, whereby it is possible to prevent the locking member 16 and the rotating drive shaft 6 from rotating at the time of revolving the fixing screw 15.

Although rotation of the rotating drive shaft 6 is transmitted to the photoconductive drum 222*a* via the locking member 16 in the embodiment described above, rotation of the rotating drive shaft 6 may be transmitted directly to the photoconductive drum 222*a* by designing at least a part of the inner periphery of the through hole 41*a* of the flange 4*a* and at least a part of the outer periphery of a portion of the rotating drive shaft 6 in which the through hole 41*a* is fitted, to have an even surface so as to have a D-shaped section, for example.

Further, although a digital full-color copier is illustrated as an example of an image forming apparatus in the embodiment described above, the invention can be applied to another image forming apparatus such as a mono-color copier or a laser printer as well.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus provided with a unit mounted with a photoconductive drum and other process devices, which unit is attachable to and detachable from a body of the apparatus, the apparatus comprising:

a coupling member provided among the body of the apparatus; and a rotating drive shaft separate from the unit for rotating and driving the photoconductive drum, the rotating drive shaft passing through the coupling member, the coupling member and rotating drive shaft being operatively configured such that the photoconductive drum of the unit is fitted onto the rotating drive shaft, and a part of a main bodv of the unit, mounted with the other process devices, is fitted onto the coupling member.

2. The image forming apparatus of claim 1, wherein the photoconductive drum is supported only by the rotating drive shaft.

3. The image forming apparatus of claim 1, wherein the coupling member is provided with a hole in which the rotating drive shaft is fitted, and an outer periphery which is concentric with the hole, and the coupling member is shaped like a cylinder so that a part of the main body of the unit is fitted onto the outer periphery of the coupling member.

4. The image forming apparatus of claim 1, wherein the coupling member is a shaft supporting member which supports a back-side portion of the rotating drive shaft in the apparatus body.

5. The image forming apparatus of claim 1, wherein the coupling member is a movement regulating member which is attached to a front-side end of the rotating drive shaft, to regulate movement of the photoconductive drum in an axial direction of the rotating drive shaft.

6. The image forming apparatus of claim 5, wherein the unit is fixed to a front-side frame of the apparatus body and is provided with a unit-side frame which supports the movement regulating member, and the main body of the unit is supported by the movement regulating member and the coupling member.

7. The image forming apparatus of claim 5, wherein the coupling member, together with a front-side end of the photoconductive drum, is fitted onto a small diameter portion which is formed in a vicinity of the front-side end of the rotating drive shaft so that the front-side end of the photoconductive drum is interposed between a back-side end face of the coupling member and a stair portion of the rotating drive shaft, to transmit rotation of the rotating drive shaft to the photoconductive drum.

8. An image forming apparatus provided with a unit mounted with a photoconductive drum and other process devices, which unit is attachable to and detachable from a body of the apparatus, comprising:

a coupling member which is fitted onto a rotating drive shaft onto which the photoconductive drum is fitted, and onto which coupling member a part of a main body of the unit, mounted with the other process devices, is fitted, wherein the coupling member is a movement regulating member which is attached to a front-side end of the rotating drive shaft, to regulate movement of the photoconductive drum in an axial direction of the rotating drive shaft, and the coupling member, together with a front-side end of the photoconductive drum, is fitted onto a small diameter portion which is formed in a vicinity of the front-side end of the rotating drive shaft so that the front-side end of the photoconductive drum is interposed between a back-side end face of the coupling member and a stair portion of the rotating drive shaft, to transmit rotation of the rotating drive shaft to the photoconductive drum.

* * * * *